US011326240B2

(12) United States Patent
Matsumoto et al.

(10) Patent No.: US 11,326,240 B2
(45) Date of Patent: May 10, 2022

(54) HOT-ROLLED STEEL SHEET FOR COILED TUBING

(71) Applicant: JFE STEEL CORPORATION, Tokyo (JP)

(72) Inventors: Akihide Matsumoto, Tokyo (JP); Hiroshi Nakata, Tokyo (JP); Shunsuke Toyoda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 183 days.

(21) Appl. No.: 16/480,803

(22) PCT Filed: Dec. 14, 2017

(86) PCT No.: PCT/JP2017/044845
§ 371 (c)(1),
(2) Date: Jul. 25, 2019

(87) PCT Pub. No.: WO2018/139095
PCT Pub. Date: Aug. 2, 2018

(65) Prior Publication Data

US 2019/0390311 A1 Dec. 26, 2019

(30) Foreign Application Priority Data

Jan. 25, 2017 (JP) ..... JP2017-010788

(51) Int. Cl.

| | |
|---|---|
| ***C22C 38/58*** | (2006.01) |
| ***C21D 8/02*** | (2006.01) |
| ***C21D 9/08*** | (2006.01) |
| ***C21D 9/46*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/58* (2013.01); *C21D 8/0226* (2013.01); *C21D 9/08* (2013.01); *C21D 9/46* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/002* (2013.01); *C21D 2211/008* (2013.01)

(58) Field of Classification Search

CPC ..... C21D 2211/001; C21D 2211/002; C21D 2211/008; C21D 8/0226; C21D 9/08; C21D 9/46; C21D 9/50; C22C 38/00; C22C 38/02; C22C 38/06; C22C 38/42; C22C 38/44; C22C 38/46; C22C 38/48; C22C 38/50; C22C 38/58

See application file for complete search history.

(56) References Cited

U.S. PATENT DOCUMENTS

| | | | |
|---|---|---|---|
| 2008/0110535 | A1 | 5/2008 | Oi et al. |
| 2012/0186686 | A1 | 7/2012 | Valdez et al. |

FOREIGN PATENT DOCUMENTS

| | | | | |
|---|---|---|---|---|
| EP | 2484791 | A1 | | 8/2012 |
| JP | H11172365 | A | | 6/1999 |
| JP | 2005-350724 | A | | 12/2005 |
| JP | 2005350724 | A | * | 12/2005 |
| JP | 2006-233263 | A | | 9/2006 |
| JP | 2006233263 | A | * | 9/2006 |
| JP | 2006299398 | A | * | 11/2006 |
| JP | 2008248330 | A | * | 10/2008 |
| JP | 2010-111931 | A | | 5/2010 |
| JP | 2010111931 | A | * | 5/2010 |
| JP | 2012031509 | A | * | 2/2012 |
| JP | 2012-214875 | A | | 11/2012 |
| JP | 2014-208888 | A | | 11/2014 |
| JP | 2017-125245 | A | | 7/2017 |
| KR | 20120062006 | A | | 6/2012 |
| WO | 2013/108861 | A1 | | 7/2013 |
| WO | 2016/143270 | A1 | | 9/2016 |

OTHER PUBLICATIONS

Mar. 13, 2018 International Search Report issued in International Patent Application No. PCT/JP2017/044845.
Nov. 26, 2020 Office Action issued in Korean Patent Application No. 10-2019-7021802.
Sep. 11, 2020 Office Action issued in Chinese Patent Application No. 201780084494.8.
Apr. 22, 2021 Office Action issued in Chinese Patent Application No. 201780084494.8.
Jun. 2, 2021 Office Action issued in Canadian Application No. 3,048,358.
Sep. 3, 2021 Office Action issued in Chinese Patent Application No. 201780084494.8.
Nov. 29, 2021 Office Action issued in U.S. Appl. No. 16/480,799.

* cited by examiner

*Primary Examiner* — Jenny R Wu
(74) *Attorney, Agent, or Firm* — Oliff PLC

(57) ABSTRACT

There is provided a hot-rolled steel sheet suitable for manufacturing an electric resistance welded steel tube, having workability necessary for roll forming and high yield strength, for coiled tubing without performing whole-tube quenching treatment and reheating-tempering treatment after electric resistance welding. The steel sheet includes, by mass %, C, Si, Mn, P, S, Al, Cr, Cu, Ni, Mo, Nb, V, Ti, and N contained at a specific content. The steel sheet has a microstructure containing 3% to 20% martensite and 10% or less retained austenite on a volume fraction basis, the remainder being bainite. The yield strength is set to 600 MPa or more, the tensile strength is set to 950 MPa or more, and the uniform elongation is set to 7.0% or more.

2 Claims, No Drawings

HOT-ROLLED STEEL SHEET FOR COILED TUBING

TECHNICAL FIELD

This application relates to a hot-rolled steel sheet for coiled tubing.

BACKGROUND

Coiled tubing is one obtained by coiling a long small-diameter steel tube with an outside diameter of about 20 mm to 100 mm on a reel. Coiled tubing has been widely used in various well operations, which is uncoiled from a reel in an operation and inserted into a well, and then pulled up from the well after the operation, and is rewound onto the reel. In particular, in recent years, coiled tubing has been used to hydraulically fracture shale layers in the mining of shale gas. Coiled tubing offers smaller equipment as compared to conventional well recovery and drilling units, enables therefore saving of footprint and number of workers, and has an advantage that the operation efficiency is high because tubes need not be connected and continuous tripping is possible.

Coiled tubing is a steel tube which is manufactured in such a manner that a hot-rolled steel sheet serving as raw material is longitudinally slit into a steel strip with an appropriate width and the steel strip is rolled into a tube form and is subjected to electric resistance welding. Thereafter, whole-pipe heat treatment is performed for the purpose of increasing the quality of a weld or obtaining desired mechanical properties.

From the viewpoint of preventing fractures in wells, coiled tubing is required to have particularly high longitudinal strength. In recent years, in order to cope with longer, deeper wells, coiled tubing has increased in strength and, in particular, coiled tubing with a yield strength of 130 ksi (896 MPa) or more has been required.

Patent Literature 1 proposes a hot-rolled steel sheet for coiled tubing, the hot-rolled steel sheet having a microstructure dominated by one of ferrite, pearlite, or bainite, and also proposes a method for manufacturing the same. In this technique, the microstructure of the hot-rolled steel sheet for coiled tubing, the microstructure being dominated by bainite or the like, is formed during hot rolling. That is, it is not necessary to form the microstructure dominated thereby during heat treatment after hot rolling. However, this technique relates to an electric resistance welded steel tube, having a yield strength of 50 ksi (345 MPa) or more, for coiled tubing and is not suitable for manufacturing an electric resistance welded steel pipe, having a yield strength of 130 ksi or more, for coiled tubing.

Patent Literature 2 proposes an electric resistance welded steel tube, having a yield strength of 140 ksi (965 MPa) or more, for coiled tubing, the electric resistance welded steel pipe having a steel microstructure dominated by tempered martensite, and also proposes a method for manufacturing the same. However, this technique requires whole-tube quenching treatment and reheating-tempering treatment after subjecting a hot-rolled steel sheet to electric resistance welding and therefore has problems with productivity and manufacturing costs.

CITATION LIST

Patent Literature

PTL 1: Domestic Re-publication of PCT International Publication for Patent Application No. 2013-108861

PTL 2: Japanese Unexamined Patent Application Publication No. 2014-208888

SUMMARY

Technical Problem

When the microstructure of a steel tube for coiled tubing is dominated by tempered martensite as described in the technique in Patent Literature 2, tempered martensite needs to be formed by heat treatment after electric resistance welding. This is due to reasons below:

(i) When an as-hot-rolled microstructure is dominated by martensite, workability necessary for roll forming is insufficient.

(ii) When a microstructure is dominated by tempered martensite formed by heat treatment prior to roll forming, whole-pipe heat treatment is necessary again for the purpose of improving the quality of an electric resistance weld, though roll forming is possible.

From the above reasons, a steel tube, having a microstructure dominated by tempered martensite, for coiled tubing is manufactured by performing reheating-tempering treatment in addition to whole-tube quenching treatment after electric resistance welding as proposed in Patent Literature 2 and therefore has problems with productivity and manufacturing costs.

As described above, the following technique has not been established: a technique for providing an electric resistance welded steel tube, having high yield strength, for coiled tubing without performing whole-tube quenching treatment and reheating-tempering treatment after performing electric resistance welding and whole-pipe heat treatment in consideration of the increase of productivity and the reduction of manufacturing costs.

The disclosed embodiments have been made in view of the above problems and have an object to provide a hot-rolled steel sheet suitable for manufacturing an electric resistance welded steel tube, having workability necessary for roll forming and high yield strength, for coiled tubing without performing whole-tube quenching treatment and reheating-tempering treatment after performing electric resistance welding and whole-pipe heat treatment.

Solution to Problem

In order to achieve the above objective, the inventors have carried out investigations for the purpose of obtaining steel having a microstructure dominated by bainite, which can be formed during hot rolling, and high yield strength without performing whole-tube quenching treatment and reheating-tempering treatment after performing electric resistance welding and whole-pipe heat treatment. As a result, the inventors have found that, in order to obtain an electric resistance welded steel tube having a desired yield strength, a hot-rolled steel sheet needs to have a yield strength of 600 MPa or more and a tensile strength of 950 MPa or more and further needs to have a uniform elongation of 7.0% or more for the purpose of ensuring workability during roll forming.

The inventors have found that, in order to allow a steel tube with a microstructure dominated by bainite to have high yield strength after performing roll forming, electric resistance welding, and whole-pipe heat treatment, it is necessary that the composition of steel for a hot-rolled steel sheet is set to a predetermined range and the volume fraction of each of bainite, martensite, and retained austenite is set to a predetermined range.

The disclosed embodiments are based on the above finding and provides Items [1] and [2] below.

[1] A hot-rolled steel sheet for coiled tubing has a composition containing C: more than 0.10% to 0.16%, Si: 0.1% to 0.5%, Mn: 1.6% to 2.5%, P: 0.02% or less, S: 0.005% or less, Al: 0.01% to 0.07%, Cr: more than 0.5% to 1.5%, Cu: 0.1% to 0.5%, Ni: 0.1% to 0.3%, Mo: 0.1% to 0.3%, Nb: 0.01% to 0.05%, V: 0.01% to 0.10%, Ti: 0.005% to 0.05%, and N: 0.005% or less on a mass basis, the remainder being Fe and inevitable impurities; has a microstructure containing 3% to 20% martensite and 10% or less retained austenite on a volume fraction basis, the remainder being bainite; and also has a yield strength of 600 MPa or more, a tensile strength of 950 MPa or more, and a uniform elongation of 7.0% or more.

[2] The hot-rolled steel sheet for coiled tubing specified in Item [1] further contains one or two selected from Sn: 0.001% to 0.005% and Ca: 0.001% to 0.003% on a mass basis in addition to the composition.

Incidentally, the whole-pipe heat treatment after electric resistance welding means that after a steel tube is heated to about 600° C. over the entire circumference and length thereof, the steel tube is cooled. An example of a whole-pipe heat treatment method is a method in which after a steel tube is heated by high-frequency induction heating, the steel tube is air-cooled. Whole-tube quenching treatment and reheating-tempering treatment, unnecessary in the disclosed embodiments, after electric resistance welding mean that after a steel tube is heated to a temperature not lower than the $Ac_3$ temperature over the entire circumference and length thereof so as to be austenitized, the steel tube is cooled at a cooling rate of 30° C./s or more and that a steel tube is heated to a temperature of 500° C. to 800° C. over the entire circumference and length thereof after whole-tube quenching treatment and is then air-cooled, respectively.

In the disclosed embodiments, the uniform elongation can be measured in terms of nominal strain at the maximum load after yield by tensile testing at a cross-head speed of 10 mm/min.

In the disclosed embodiments, the yield strength can be measured in terms of 0.2% proof stress according to the API-5ST standard by tensile testing at a cross-head speed of 10 mm/min. Furthermore, the tensile strength can be measured in terms of nominal stress at the maximum load after yield by the above testing.

Advantageous Effects

According to the disclosed embodiments, a hot-rolled steel sheet having a uniform elongation of 7.0%, a yield strength of 600 MPa or more, a tensile strength of 950 MPa or more can be obtained. That is, according to the disclosed embodiments, the following sheet can be provided: a hot-rolled steel sheet suitable for manufacturing an electric resistance welded steel tube for coiled tubing with high productivity and low cost, the electric resistance welded steel tube having workability necessary for roll forming and high yield strength.

Using a hot-rolled steel sheet according to the disclosed embodiments enables, for example, an electric resistance welded steel tube, having a yield strength of 130 ksi (896 MPa) or more, for coiled tubing to be obtained.

DETAILED DESCRIPTION

A hot-rolled steel sheet for coiled tubing according to the disclosed embodiments has a composition containing C: more than 0.10% to 0.16%, Si: 0.1% to 0.5%, Mn: 1.6% to 2.5%, P: 0.02% or less, S: 0.005% or less, Al: 0.01% to 0.07%, Cr: more than 0.5% to 1.5%, Cu: 0.1% to 0.5%, Ni: 0.1% to 0.3%, Mo: 0.1% to 0.3%, Nb: 0.01% to 0.05%, V: 0.01% to 0.10%, Ti: 0.005% to 0.05%, and N: 0.005% or less on a mass basis, the remainder being Fe and inevitable impurities; has a microstructure containing 3% to 20% martensite and 10% or less retained austenite on a volume fraction basis, the remainder being bainite; and also has a yield strength of 600 MPa or more, a tensile strength of 950 MPa or more, and a uniform elongation of 7.0% or more.

First, reasons for limiting the composition of steel for a hot-rolled steel sheet according to the disclosed embodiments are described below. In the specification, the unit "%" used to express the composition of steel refers to "mass percent" unless otherwise specified.

C: more than 0.10% to 0.16%

C is an element which increases the strength of steel and which enhances the hardenability. Therefore, in order to ensure a desired strength and microstructure, more than 0.10% C needs to be contained. However, when the content of C is more than 0.16%, the weldability is poor, the fractions of martensite and retained austenite are high, and therefore no desired yield strength is obtained. Therefore, the C content is set to more than 0.10% to 0.16%. The C content is preferably 0.11% or more and is preferably 0.13% or less.

Si: 0.1% to 0.5%

Si is an element which acts as a deoxidizer and which suppresses the formation of scales during hot rolling to contribute to the reduction in amount of scale-off. In order to obtain such an effect, 0.1% or more Si needs to be contained. However, when the content of Si is more than 0.5%, the weldability is poor. Therefore, the Si content is set to 0.1% to 0.5%. The Si content is preferably 0.2% or more and is preferably 0.4% or less.

Mn: 1.6% to 2.5%

Mn is an element which enhances the hardenability and which delays a ferrite transformation during cooling after finish rolling to contribute to forming a bainite-dominated microstructure. In order to ensure a desired strength and microstructure, 1.6% or more Mn needs to be contained. However, when the content of Mn is more than 2.5%, the weldability is poor, the fractions of martensite and retained austenite are high, and therefore no desired yield strength is obtained. Therefore, the Mn content is set to 1.6% to 2.5%. The Mn content is preferably 1.8% or more and is preferably 2.1% or less.

P: 0.02% or less

P segregates at grain boundaries to cause the heterogeneity of material and therefore the content of P is preferably minimized as an inevitable impurity. A P content of up to about 0.02% is acceptable. Therefore, the P content is within a range of 0.02% or less. The P content is preferably 0.01% or less.

S: 0.005% or less

S is usually present in steel in the form of MnS. MnS is thinly elongated in a hot rolling process to negatively affect the ductility. Therefore, in the disclosed embodiments, the content of S is preferably minimized. An S content of up to about 0.005% is acceptable. Therefore, the S content is set to 0.005% or less. The S content is preferably 0.003% or less.

Al: 0.01% to 0.07%

Al is an element acting as a strong deoxidizer. In order to obtain such an effect, 0.01% or more Al needs to be contained. However, when the content of Al is more than 0.07%, the amount of alumina inclusions is large and surface properties are poor. Therefore, the Al content is set to 0.01% to 0.07%. The Al content is preferably 0.02% or more and is preferably 0.05% or less.

Cr: more than 0.5% to 1.5%

Cr is an element added for the purpose of imparting corrosion resistance. Cr increases the resistance to temper softening and therefore suppresses softening during whole-pipe heat treatment after tube making. Furthermore, Cr is an element which enhances the hardenability to contribute to ensuring a desired strength and martensite fraction. In order to obtain such an effect, more than 0.5% Cr needs to be contained. However, when the content of Cr is more than 1.5%, the weldability is poor. Therefore, the Cr content is set to more than 0.5% to 1.5%. The Cr content is preferably more than 0.5% to 1.0%. The Cr content is more preferably 0.8% or less.

Cu: 0.1% to 0.5%

Cu, as well as Cr, is an element added for the purpose of imparting corrosion resistance. In order to obtain such an effect, 0.1% or more Cu needs to be contained. However, when the content of Cu is more than 0.5%, the weldability is poor. Therefore, the Cu content is set to 0.1% to 0.5%. The Cu content is preferably 0.2% or more and is preferably 0.4% or less.

Ni: 0.1% to 0.3%

Ni, as well as Cr and Cu, is an element added for the purpose of imparting corrosion resistance. In order to obtain such an effect, 0.1% or more Ni needs to be contained. However, when the content of Ni is more than 0.3%, the weldability is poor. Therefore, the Ni content is set to 0.1% to 0.3%. The Ni content is preferably 0.1% to 0.2%.

Mo: 0.1% to 0.3%

Mo is an element enhancing the hardenability. Therefore, in the disclosed embodiments, 0.1% or more Mo needs to be contained for the purpose of ensuring a desired strength and martensite fraction. However, when the content of Mo is more than 0.3%, the weldability is poor, the fraction of martensite is high, and no desired strength is obtained. Therefore, the Mo content is set to 0.1% to 0.3%. The Mo content is preferably 0.2% to 0.3%.

Nb: 0.01% to 0.05%

Nb is an element which precipitates in the form of fine NbC during hot rolling to contribute to increasing the strength. Therefore, 0.01% or more Nb needs to be contained for the purpose of ensuring a desired strength. However, when the content of Nb is more than 0.05%, Nb is unlikely to form a solid solution at a hot-rolling heating temperature and an increase in strength appropriate to the content thereof is not achieved. Therefore, the Nb content is set to 0.01% to 0.05%. The Nb content is preferably 0.03% to 0.05%.

V: 0.01% to 0.10%

V is an element which precipitates in the form of fine carbonitrides during hot rolling to contribute to increasing the strength. Therefore, 0.01% or more V needs to be contained for the purpose of ensuring a desired strength. However, when the content of V is more than 0.10%, coarse precipitates are formed to reduce the weldability. Therefore, the V content is set to 0.01% to 0.10%. The V content is preferably 0.04% or more and is preferably 0.08% or less.

Ti: 0.005% to 0.05%

Ti precipitates in the form of TiN to inhibit the bonding between Nb and N, thereby precipitating fine NbC. As described above, Nb is an element which is important from the viewpoint of increasing the strength of steel. In the case where Nb combines with N, NbC derived from Nb(CN) precipitates and high strength is unlikely to be obtained. In order to obtain such an effect, 0.005% or more Ti needs to be contained. However, when the content of Ti is more than 0.05%, the amount of TiC is large and the amount of fine NbC is small. Therefore, the Ti content is set to 0.005% to 0.05%. The Ti content is preferably 0.010% or more and is preferably 0.03% or less.

N: 0.005% or less

Although N is an inevitable impurity, the formation of Nb nitrides reduces the amount of fine NbC. Therefore, the content of N is within a range of 0.005% or less. The N content is preferably 0.003% or less.

The remainder other than the above components are Fe and inevitable impurities. As inevitable impurities, Co: 0.1% or less and B: 0.0005% or less, are acceptable.

The above components are fundamental components of the steel for the hot-rolled steel sheet according to the disclosed embodiments. In addition to these, one or two selected from Sn: 0.001% to 0.005% and Ca: 0.001% to 0.003% may be contained.

Sn: 0.001% to 0.005%

Sn is added for corrosion resistance as required. In order to obtain such an effect, 0.001% or more Sn is contained. However, when the content of Sn is more than 0.005%, Sn segregates to cause unevenness in strength in some cases. Therefore, when Sn is contained, the Sn content is preferably set to 0.001% to 0.005%.

Ca: 0.001% to 0.003%

Ca is an element which spheroidizes sulfides, such as MnS, thinly elongated in the hot rolling process to contribute to increasing the toughness of steel and which is added as required. In order to obtain such an effect, 0.001% or more Ca is contained. However, when the content of Ca is more than 0.003%, Ca oxide clusters are formed in steel to impair the toughness in some cases. Therefore, when Ca is contained, the Ca content is set to 0.001% to 0.003%.

Next, reasons for limiting the microstructure of the hot-rolled steel sheet according to the disclosed embodiments are described.

The hot-rolled steel sheet according to the disclosed embodiments has a microstructure containing 3% to 20% martensite and 10% or less retained austenite on a volume fraction basis, the remainder being bainite. The reason why the microstructure is dominated by bainite (70% or more) is to obtain a desired yield strength.

Since martensite is harder than bainite and introduces movable dislocations into surrounding bainite when being formed, martensite reduces the yield strength, increases the uniform elongation, and enhances the formability into steel tubes. Therefore, the volume fraction thereof needs to be 3% or more. When the volume fraction thereof is more than 20%, no desired yield strength is obtained. The volume fraction thereof is preferably 5% to 15%.

Since retained austenite transforms into martensite, which is hard, in the formation into a steel tube, retained austenite reduces the yield strength, increases the uniform elongation, and enhances the formability into steel tubes. However, when the volume fraction thereof is more than 10%, no desired yield strength is obtained after a steel tube is formed. When 3% or more martensite, which is hard, is contained, the formability into steel tubes can be ensured and therefore the lower limit of the volume fraction of retained austenite may be 0%. The volume fraction thereof is preferably 7% or less.

Herein, the volume fraction of retained austenite is measured by X-ray diffraction. The volume fractions of martensite and bainite are measured from a SEM image obtained using a scanning electron microscope (SEM, a magnification of 2,000 times to 5,000 times). In SEM images, it is difficult to distinguish martensite and retained austenite. Therefore, the area fraction of a microstructure found to be martensite or retained austenite is measured from the obtained SEM image and is converted into the volume fraction of martensite or retained austenite and a value obtained by subtracting the volume fraction of retained austenite therefrom is taken as the volume fraction of martensite. The volume fraction of bainite is calculated as the rest other than martensite and retained austenite.

Next, a method for manufacturing the hot-rolled steel sheet according to the disclosed embodiments is described.

In the disclosed embodiments, for example, steel, such as a slab, having the above composition is not particularly limited and is heated to a temperature of 1,150° C. to 1,280° C., followed by hot rolling under conditions including a finishing delivery temperature of 840° C. to 920° C. and a coiling temperature of 500° C. to 600° C.

When the heating temperature in a hot rolling process is lower than 1,150° C., the remelting of coarse Nb and V carbonitrides is insufficient, thereby causing a reduction in strength. However, when the heating temperature is higher than 1,280° C., austenite grains are coarsened and the number of sites for forming precipitates during hot rolling is reduced, thereby causing a reduction in strength.

Therefore, the heating temperature in the hot rolling process is preferably 1,150° C. to 1,280° C.

When the finishing delivery temperature is lower than 840° C., ferrite, which is soft, is formed, thereby causing a reduction in strength. Furthermore, shape deterioration due to residual stress after slitting is significant. However, when the finishing delivery temperature is higher than 920° C., the rolling reduction in the unrecrystallized austenite region is insufficient, no fine austenite grains are obtained, and the number of sites for forming precipitates is reduced, thereby causing a reduction in strength. Therefore, the finishing delivery temperature is preferably 840° C. to 920° C.

When the coiling temperature is lower than 500° C., the formation of Nb and V precipitates is suppressed, thereby causing a reduction in strength. However, when the coiling temperature is higher than 600° C., ferrite, which is soft, is formed and coarse Nb and V precipitates are also formed, thereby causing a reduction in strength. Therefore, the coiling temperature is preferably 500° C. to 600° C.

The hot-rolled steel sheet may be pickled or shot-blasted for the purpose of removing oxidized scales from surface layers.

Subsequently, a method for manufacturing an electric resistance welded steel tube for coiled tubing using the hot-rolled steel sheet according to the disclosed embodiments is described. The hot-rolled steel sheet (steel strip) is roll-formed into a tube shape and is subjected to electric resistance welding, whereby a steel tube is obtained. The steel tube is subjected to whole-pipe heat treatment at a temperature of about 600° C., for example, a temperature of 550° C. or more. This heat treatment enables the quality of an electric resistance weld to be improved. In the disclosed embodiments, whole-tube quenching treatment and reheating-tempering treatment after electric resistance welding are unnecessary to manufacture the steel tube by subjecting the hot-rolled steel sheet to electric resistance welding, thereby enabling an increase in productivity and the reduction of manufacturing costs to be achieved.

EXAMPLES

The disclosed embodiments are further described below with reference to examples.

Steels having a composition shown in Table 1 were produced in a converter and were formed into slabs (steels) by a continuous casting process. After being heated to 1,200° C., these were hot-rolled at a finishing delivery temperature and coiling temperature shown in Table 1, whereby hot-rolled steel sheets with a finish thickness of 3.3 mm were obtained. JIS No. 5 tensile specimens (a gauge length of 50 mm, a parallel portion width of 25 mm) were cut out of the obtained hot-rolled steel sheets such that a rolling direction (hereinafter referred to as the L direction) was parallel to a tensile direction, followed by applying the 6% tensile strain corresponding to the L-direction tube-making strain to the specimens using a tensile tester and then measuring as-hot-rolled mechanical properties (yield strength, tensile strength, and uniform elongation). After the specimens to which the 6% tensile strain was applied using the tensile tester were subjected to annealing simulating whole-pipe heat treatment at 600° C. for 90 seconds and were cooled, the specimens were subjected to a tensile test, whereby the same yield strength as after pipe making and annealing was obtained. Furthermore, the specimens heat-treated under the above conditions were observed for microstructure and was measured for retained austenite volume fraction.

The tensile test was performed at a cross head speed of 10 mm/min. In accordance with the API-5ST standard, the 0.2% proof stress was taken as the yield strength. The tensile strength was taken as the nominal stress at the maximum load after yield. The uniform elongation was taken as the nominal strain at the maximum load after yield.

The volume fractions of martensite and bainite were measured from a SEM image obtained using a scanning electron microscope (SEM, a magnification of 2,000 times to 5,000 times). In SEM images, it was difficult to distinguish martensite and retained austenite. Therefore, the area fraction of a microstructure found to be martensite or retained austenite was measured from the obtained SEM image and was converted into the volume fraction of martensite or retained austenite and a value obtained by subtracting the volume fraction of retained austenite therefrom was taken as the volume fraction of martensite. The volume fraction of bainite was calculated as the rest other than martensite and retained austenite. The volume fractions of ferrite and pearlite were similarly determined from the SEM image. A sample for observation was prepared in such a manner that the sample was taken such that an observation surface corresponded to a rolling-direction cross section during hot rolling, followed by polishing and then nital etching. The area fraction of a microstructure was calculated in such a manner that five or more fields of view were observed at a through-thickness one-half position and measurements obtained in the fields of view were averaged.

The volume fraction of retained austenite was measured by X-ray diffraction. A sample for measurement was prepared in such a manner that the sample was ground such that a diffraction plane was located at a through-thickness one-half position, followed by removing a surface processed layer by chemical polishing. Mo-K$\alpha$ radiation was used for measurement and the volume fraction of retained austenite was determined from the integrated intensities of the (200), (220) and (311) planes of fcc iron and the (200) and (211) planes of bcc iron.

Table 2 shows mechanical properties of Steel Sheet Nos. 1 to 23 in Table 1. Hot-rolled steel sheets having a uniform elongation of 7.0% or more, a yield strength YS of 600 MPa or more, and a tensile strength TS of 950 MPa or more were rated acceptable.

TABLE 1

| Steel | Composition (mass percent) | | | | | | | | | | | | | | | | Hot rolling conditions | | As-hot-rolled microstructure* | | | | | | |
|---|---|---|---|---|---|---|---|---|---|---|---|---|---|---|---|---|---|---|---|---|---|---|---|---|---|
| | | | | | | | | | | | | | | | | | Finishing delivery temperature | Coiling temperature | | Volume fraction (%) | | | | | |
| No. | C | Si | Mn | P | S | Al | Cr | Cu | Ni | Mo | Nb | V | Ti | N | Sn | Ca | (° C.) | (° C.) | Type | F | P | A | M | B | Remarks |
| 1 | 0.115 | 0.36 | 1.94 | 0.010 | 0.0024 | 0.032 | 0.61 | 0.28 | 0.16 | 0.25 | 0.042 | 0.061 | 0.018 | 0.0035 | — | — | 900 | 540 | B + M | 0 | 0 | 0 | 6 | 94 | Example |
| 2 | 0.113 | 0.34 | 1.97 | 0.013 | 0.0024 | 0.032 | 0.60 | 0.41 | 0.20 | 0.26 | 0.042 | 0.060 | 0.015 | 0.0035 | — | 0.0022 | 880 | 510 | B + M | 0 | 0 | 0 | 4 | 96 | Example |
| 3 | 0.135 | 0.34 | 1.96 | 0.011 | 0.0022 | 0.039 | 0.60 | 0.27 | 0.18 | 0.26 | 0.041 | 0.060 | 0.015 | 0.0031 | 0.002 | 0.0026 | 860 | 530 | B + M + A | 0 | 0 | 1 | 12 | 87 | Example |
| 4 | 0.113 | 0.35 | 1.97 | 0.010 | 0.0021 | 0.034 | 0.60 | 0.27 | 0.17 | 0.25 | 0.003 | 0.001 | 0.016 | 0.0028 | — | — | 890 | 550 | B + M | 0 | 0 | 0 | 8 | 92 | Comparative example |
| 5 | 0.110 | 0.36 | 1.41 | 0.009 | 0.0021 | 0.035 | 0.60 | 0.27 | 0.17 | 0.02 | 0.040 | 0.060 | 0.016 | 0.0035 | — | — | 850 | 540 | F+P | 88 | 12 | 0 | 0 | 0 | Comparative example |
| 6 | 0.090 | 0.39 | 1.97 | 0.010 | 0.0020 | 0.048 | 0.62 | 0.27 | 0.17 | 0.26 | 0.046 | 0.064 | 0.016 | 0.0029 | 0.002 | 0.0029 | 870 | 580 | B + M | 0 | 0 | 0 | 5 | 95 | Comparative example |
| 7 | 0.152 | 0.28 | 1.65 | 0.005 | 0.0025 | 0.030 | 0.60 | 0.30 | 0.16 | 0.25 | 0.040 | 0.070 | 0.035 | 0.0025 | — | — | 910 | 530 | B + M + A | 0 | 0 | 2 | 11 | 87 | Example |
| 8 | 0.121 | 0.44 | 2.30 | 0.008 | 0.0030 | 0.042 | 0.85 | 0.14 | 0.13 | 0.20 | 0.035 | 0.022 | 0.013 | 0.0040 | — | — | 850 | 550 | B + M + A | 0 | 0 | 7 | 17 | 76 | Example |
| 9 | 0.140 | 0.47 | 1.83 | 0.012 | 0.0024 | 0.061 | 0.70 | 0.35 | 0.20 | 0.19 | 0.019 | 0.060 | 0.017 | 0.0034 | — | — | 890 | 570 | B + M + A | 0 | 0 | 4 | 7 | 89 | Example |
| 10 | 0.153 | 0.48 | 2.61 | 0.010 | 0.0025 | 0.031 | 0.59 | 0.35 | 0.19 | 0.12 | 0.041 | 0.062 | 0.016 | 0.0027 | — | — | 870 | 520 | B + M + A | 0 | 0 | 12 | 15 | 73 | Comparative example |
| 11 | 0.116 | 0.35 | 1.97 | 0.013 | 0.0023 | 0.034 | 0.85 | 0.30 | 0.17 | 0.40 | 0.042 | 0.060 | 0.018 | 0.0041 | — | — | 900 | 560 | B + M + A | 0 | 0 | 5 | 24 | 71 | Comparative example |
| 12 | 0.114 | 0.36 | 1.45 | 0.011 | 0.0027 | 0.036 | 0.60 | 0.29 | 0.15 | 0.25 | 0.040 | 0.061 | 0.019 | 0.0038 | — | — | 880 | 530 | F+P | 81 | 19 | 0 | 0 | 0 | Comparative example |
| 13 | 0.132 | 0.35 | 2.31 | 0.011 | 0.0020 | 0.045 | 0.61 | 0.27 | 0.16 | 0.04 | 0.043 | 0.061 | 0.019 | 0.0024 | — | — | 920 | 580 | B + M | 0 | 0 | 0 | 2 | 98 | Comparative example |
| 14 | 0.112 | 0.35 | 1.94 | 0.010 | 0.0023 | 0.030 | 0.61 | 0.26 | 0.16 | 0.24 | 0.004 | 0.060 | 0.017 | 0.0029 | — | — | 890 | 550 | B + M | 0 | 0 | 0 | 6 | 94 | Comparative example |

TABLE 1-continued

| Steel | Composition (mass percent) | | | | | | | | | | | | | | | | Hot rolling conditions | | As-hot-rolled microstructure* | | | | | | |
|---|---|---|---|---|---|---|---|---|---|---|---|---|---|---|---|---|---|---|---|---|---|---|---|---|---|
| | | | | | | | | | | | | | | | | | Finishing delivery temperature | Coiling temperature | | Volume fraction (%) | | | | | |
| No. | C | Si | Mn | P | S | Al | Cr | Cu | Ni | Mo | Nb | V | Ti | N | Sn | Ca | (° C.) | (° C.) | Type | F | P | A | M | B | Remarks |
| 15 | 0.118 | 0.33 | 1.96 | 0.012 | 0.0025 | 0.033 | 0.59 | 0.25 | 0.18 | 0.26 | 0.041 | 0.002 | 0.019 | 0.0026 | — | — | 860 | 570 | B + M + A | 0 | 0 | 1 | 9 | 90 | Comparative example |
| 16 | 0.114 | 0.36 | 1.95 | 0.010 | 0.0024 | 0.029 | 0.60 | 0.28 | 0.17 | 0.26 | 0.042 | 0.060 | 0.003 | 0.0033 | — | — | 870 | 560 | B + M | 0 | 0 | 0 | 4 | 96 | Comparative example |
| 17 | 0.087 | 0.35 | 1.93 | 0.009 | 0.0021 | 0.032 | 0.60 | 0.28 | 0.16 | 0.25 | 0.043 | 0.062 | 0.017 | 0.0037 | — | — | 880 | 540 | B + M | 0 | 0 | 0 | 3 | 97 | Comparative example |
| 18 | 0.143 | 0.34 | 1.94 | 0.010 | 0.0030 | 0.036 | 1.45 | 0.28 | 0.17 | 0.25 | 0.041 | 0.060 | 0.017 | 0.0028 | — | — | 860 | 550 | B + M + A | 0 | 0 | 4 | 9 | 87 | Example |
| 19 | 0.108 | 0.36 | 1.69 | 0.011 | 0.0026 | 0.034 | 0.41 | 0.27 | 0.17 | 0.24 | 0.040 | 0.061 | 0.018 | 0.0033 | — | — | 880 | 580 | B + M | 0 | 0 | 0 | 2 | 98 | Comparative example |
| 20 | 0.115 | 0.36 | 1.94 | 0.010 | 0.0024 | 0.032 | 0.61 | 0.28 | 0.16 | 0.25 | 0.042 | 0.061 | 0.018 | 0.0035 | — | — | 800 | 550 | F+B+M | 14 | 0 | | 18 | 68 | Comparative example |
| 21 | 0.115 | 0.36 | 1.94 | 0.010 | 0.0024 | 0.032 | 0.61 | 0.28 | 0.16 | 0.25 | 0.042 | 0.061 | 0.018 | 0.0035 | — | — | 990 | 660 | F+B+M | 11 | 0 | | 21 | 68 | Comparative example |
| 22 | 0.110 | 0.37 | 1.89 | 0.009 | 0.0035 | 0.033 | 0.60 | 0.28 | 0.17 | 0.25 | 0.041 | 0.060 | 0.055 | 0.0034 | — | — | 850 | 560 | B + M | 0 | 0 | | 10 | 90 | Comparative example |
| 23 | 0.115 | 0.34 | 1.94 | 0.011 | 0.0044 | 0.040 | 0.71 | 0.28 | 0.16 | 0.25 | 0.040 | 0.059 | 0.017 | 0.0031 | — | — | 930 | 580 | B + M | 0 | 0 | | 9 | 91 | Comparative example |

In the composition, the remainder other than the above are Fe and inevitable impurities.
Underlined letters are outside the scope of the disclosed embodiments.
F: ferrite, P: pearlite, B: bainite, M: martensite, A: retained austenite

TABLE 2

| Steel No. | As-hot-rolled Yield strength (MPa) | As-hot-rolled Tensile strength (MPa) | As-hot-rolled Uniform elongation (%) | Tube making and annealed equivalent Yield strength (MPa) | Remarks |
|---|---|---|---|---|---|
| 1 | 634 | 1021 | 8.0 | 1042 | Example |
| 2 | 657 | 1019 | 7.9 | 976 | Example |
| 3 | 696 | 1067 | 9.6 | 997 | Example |
| 4 | 571 | 892 | 8.4 | 823 | Comparative example |
| 5 | 543 | 686 | 9.8 | 694 | Comparative example |
| 6 | 588 | 863 | 8.5 | 788 | Comparative example |
| 7 | 617 | 1077 | 9.1 | 1059 | Example |
| 8 | 608 | 1086 | 10.2 | 989 | Example |
| 9 | 622 | 1052 | 8.8 | 1011 | Example |
| 10 | 560 | 1052 | 10.1 | 818 | Comparative example |
| 11 | 575 | 1013 | 9.5 | 861 | Comparative example |
| 12 | 579 | 721 | 8.7 | 740 | Comparative example |
| 13 | 769 | 1038 | 6.7 | 967 | Comparative example |
| 14 | 577 | 964 | 7.8 | 815 | Comparative example |
| 15 | 523 | 992 | 8.6 | 831 | Comparative example |
| 16 | 585 | 981 | 7.7 | 866 | Comparative example |
| 17 | 592 | 946 | 7.6 | 880 | Comparative example |
| 18 | 620 | 1022 | 8.6 | 963 | Example |
| 19 | 587 | 913 | 7.5 | 837 | Comparative example |
| 20 | 584 | 825 | 11.4 | 854 | Comparative example |
| 21 | 541 | 789 | 9.7 | 866 | Comparative example |
| 22 | 567 | 875 | 8.8 | 581 | Comparative example |
| 23 | 570 | 903 | 8.6 | 877 | Comparative example |

Underlined letters are outside the scope of the disclosed embodiments.

In Tables 1 and 2, Steel Nos. 1 to 3, 7 to 9, and 18 are Examples and Steel Nos. 4 to 6, 10 to 17, and 19 to 23 are Comparative Examples. Among the Examples, Steel No. 2 is an example added with Ca and Steel No. 3 is an example added with Sn and Ca. The microstructure of each Example was dominated by bainite and had a martensite fraction of 3% to 20% and a retained austenite fraction of 10% or less. For the Examples, hot-rolled steel sheets had a yield strength of 600 MPa or more, a tensile strength of 950 MPa or more, and a uniform elongation of 7.0% or more. In the Examples, the yield strength of tube making annealed equivalents could be set to 130 ksi (896 MPa) or more. In the Examples, an increase in productivity and the reduction of manufacturing costs could be achieved without performing whole-tube quenching treatment and reheating-tempering treatment.

However, since Steel No. 4, which was a Comparative Example, a Nb content and V content below the scope of the disclosed embodiments, the yield strength and tensile strength of a hot-rolled steel sheet were outside the scope of the disclosed embodiments and the yield strength of a tube making annealed equivalent was short of 130 ksi. Since Steel Nos. 5 and 12 had a Mn or Mo content below the scope of the disclosed embodiments and also had a microstructure outside the scope of the disclosed embodiments, the yield strength and tensile strength of hot-rolled steel sheets were short of desired values.

Steel Nos. 6 and 14 to 17 had a C, Nb, V, or Ti content below the scope of the disclosed embodiments and one or both of the yield strength and tensile strength of hot-rolled steel sheets were short of desired values. Since Steel Nos. 10 and 11 had a Mn or Mo content above the scope of the disclosed embodiments and also had a microstructure outside the scope of the disclosed embodiments, the yield strength of hot-rolled steel sheets was short of a desired value.

Steel No. 13 had a Mo content below the scope of the disclosed embodiments and also had a microstructure outside the scope of the disclosed embodiments and the uniform elongation was short of 7.0%.

Since Steel No. 19 had a Cr content below the scope of the disclosed embodiments and also had a microstructure outside the scope of the disclosed embodiments, the yield strength and tensile strength of a hot-rolled steel sheet were short of desired values.

Since Steel Nos. 20, 21, and 22, which had a composition within the scope of the disclosed embodiments, had a microstructure outside the scope of the disclosed embodiments, the yield strength and tensile strength of hot-rolled steel sheets were short of desired values.

For Steel No. 23, the yield strength and tensile strength of a hot-rolled steel sheet were short of desired values.

From the above, using a hot-rolled steel sheet having a microstructure dominated by bainite enables an electric resistance welded steel tube for coiled tubing to be manufactured with high productivity and low cost. Furthermore, adjusting the composition and microstructure of the hot-rolled steel sheet within the scope of the disclosed embodiments allows the hot-rolled steel sheet to have workability necessary for roll forming and enables a yield strength of 130 ksi (896 MPa) or more to be obtained after tube making annealing.

The invention claimed is:

1. A hot-rolled steel sheet for coiled tubing having a chemical composition comprising, by mass %:

C: more than 0.10% to 0.16%,
Si: 0.1% to 0.5%,
Mn: 1.6% to 2.5%,
P: 0.02% or less,
S: 0.005% or less,
Al: 0.01% to 0.07%,
Cr: more than 0.5% to 1.5%,
Cu: 0.1% to 0.5%,
Ni: 0.1% to 0.3%,
Mo: 0.1% to 0.3%,
Nb: 0.01% to 0.05%,
V: 0.01% to 0.10%,
Ti: 0.005% to 0.05%,
N: 0.005% or less, and
a balance being Fe and inevitable impurities, wherein the hot-rolled steel sheet has a microstructure comprising in a range of 3% to 20% martensite, 2% or more and 10% or less retained austenite on a volume fraction basis, and a remainder being bainite, and the hot-rolled steel sheet has a yield strength of 600 MPa or more, a tensile strength of 1022 MPa or more, and a uniform elongation of 7.0% or more.

2. The hot-rolled steel sheet for coiled tubing according to claim 1, wherein the chemical composition further comprises, by mass %, at least one of Sn: 0.001% to 0.005% and Ca: 0.001% to 0.003%.

* * * * *